US005626895A

United States Patent [19]

Götz

[11] Patent Number: 5,626,895

[45] Date of Patent: May 6, 1997

[54] INFUSION BAG

[75] Inventor: Christoph Götz, Hanover, Germany

[73] Assignee: Abraham's Tea House GmbH, Hanover, Germany

[21] Appl. No.: 387,045

[22] Filed: Feb. 10, 1995

[30] Foreign Application Priority Data

Feb. 14, 1994 [DE] Germany ..... 44 04 611.1

[51] Int. Cl.[6] ..... A47G 19/16

[52] U.S. Cl. ..... 426/82; 206/0.5; 383/35; 383/36; 383/107; 426/77; 99/323

[58] Field of Search ..... 426/77–84; 99/295, 99/321–323; 383/107, 36, 35; 206/0.5

[56] References Cited

U.S. PATENT DOCUMENTS

| | | | |
|---|---|---|---|
| 1,980,953 | 11/1934 | Kilmer | 383/35 |
| 2,186,087 | 1/1940 | Yates | 426/77 |
| 2,248,843 | 7/1941 | Atwood | 229/938 |
| 2,377,118 | 5/1945 | Weisman | 426/77 |
| 2,562,456 | 7/1951 | Gunnar | 426/82 |
| 2,571,138 | 10/1951 | Irmscher | 426/77 |
| 3,556,392 | 1/1971 | Robin | 426/83 |
| 3,734,154 | 5/1973 | Polk | 383/35 |
| 4,171,764 | 10/1979 | Schonbach et al. | 383/36 |
| 4,224,168 | 9/1980 | Tragardh | 99/295 |
| 4,229,481 | 10/1980 | Fornari | 426/82 |
| 4,478,386 | 10/1984 | Mikkelsen | 383/36 |
| 4,619,830 | 10/1986 | Napier | 426/82 |
| 4,680,185 | 7/1987 | Illk | 426/77 |
| 4,686,814 | 8/1987 | Yanase | 383/36 |
| 4,838,327 | 6/1989 | Ambler et al. | 383/36 |

FOREIGN PATENT DOCUMENTS

| | | | |
|---|---|---|---|
| 0020598 | 11/1979 | European Pat. Off. . | |
| 1600880 | 9/1970 | France . | |
| 2217927 | 4/1972 | Germany . | |
| 2434284 | 1/1976 | Germany | 426/77 |
| 2515946 | 10/1976 | Germany . | |
| 2644667 | 4/1978 | Germany | 426/77 |
| 9104897 | 9/1991 | Germany . | |
| 9318540 | 12/1994 | Germany . | |
| 54657 | 1/1993 | Japan | 426/77 |
| 7603016 | 5/1977 | Netherlands | 426/77 |
| 7610596 | 6/1977 | Netherlands | 426/77 |
| 329234 | 4/1958 | Switzerland | 426/77 |
| 549764 | 12/1942 | United Kingdom . | |
| 887850 | 1/1962 | United Kingdom | 426/77 |
| 939934 | 10/1963 | United Kingdom | 426/77 |
| WO8001037 | 5/1980 | WIPO | 426/77 |

*Primary Examiner*—Steven Weinstein
*Attorney, Agent, or Firm*—Spencer & Frank

[57] ABSTRACT

An infusion bag of liquid-pervious filter material has a bottom edge and opposite side edges and is formed of face-to-face arranged first and second panels secured to one another along the bottom edge and the side edges. The first and second panels together define an opening spaced from the bottom edge. The first and second panels have a length dimension viewed in a direction away from the bottom edge. The length dimension of the first panel is greater than the length dimension of the second panel, whereby the first panel includes a flap extending beyond the opening in a direction away from the bottom edge.

5 Claims, 1 Drawing Sheet

INFUSION BAG

CROSS REFERENCE TO RELATED APPLICATION

This application claims the priority of German Application No. P 44 04 611.1 filed Feb. 14, 1994, which is incorporated herein by reference.

BACKGROUND OF THE INVENTION

This invention relates to an infusion bag, that is, a liquid-pervious bag containing a substance, such as tea leaves for preparing beverages. The infusion bag is of the type which has two face-to-face arranged panels of liquid-pervious filter material sealed, bonded or otherwise continuously connected to one another to form a bottom as well as front and rear side walls and has an unsealed portion forming an opening situated opposite the bottom. Such a construction is disclosed, for example, in European patent document 0 020 598 B1.

In addition to egg-shaped, perforated, usually metal containers for tea leaves to be submerged in teapots for the preparation of tea, closed bags made of filter material have been known which contain a predetermined quantity of tea leaves. Also, filter inserts (funnel-shaped members) are known which are clamped into a holder and may then receive tea leaves.

The infusion bag disclosed in EP 0 020 598 B1 is formed of a bag made of a filter material and having an opening. The bag is subdivided into a funnel portion and a receiving portion. The opening of the bag is provided at the upper end of the funnel portion, that is, at that end which is oriented away from the receiving portion. Between the two portions a passage is provided whose inner width is significantly less than the inner width of the receiving portion. It is a disadvantage of this construction that the introduction of tea leaves is difficult. The opening of the initially flat bag cannot be satisfactorily brought to the size necessary for an easy insertion of the tea leaves. It is a further disadvantage of this prior art construction that the passage between the funnel portion and the receiving portion is too narrow to permit a free and simple throughflow of the tea leaves.

SUMMARY OF THE INVENTION

It is an object of the invention to provide an infusion bag of the above-outlined type which eliminates the discussed disadvantages and which is easier to manufacture and simpler to handle.

This object and others to become apparent as the specification progresses, are accomplished by the invention, according to which, briefly stated, the infusion bag of liquid-pervious filter material has a bottom edge and opposite side edges and is formed of face-to-face arranged first and second panels secured to one another along the bottom edge and the side edges. The first and second panels together define an opening spaced from the bottom edge. The first and second panels have a length dimension viewed in a direction away from the bottom edge. The length dimension of the first panel is greater than the length dimension of the second panel, whereby the first panel includes a flap extending beyond the opening in a direction away from the bottom edge.

The infusion bag according to the invention is of simple construction and is easy to handle. The opening is situated directly at the end of the bag part (container part) which in its entirety serves only as a receiving portion for the substance, for example, tea leaves. Because of the presence of the flap, the opening is not situated at the end zone of the entire bag structure (including the bag part and the flap), but in the mid region thereof. For this reason, it is particularly easy to enlarge the opening.

The flap serves a useful, advantageous function for introducing the tea leaves into the bag. For widening the opening, the flap is bent in its longitudinal direction and thus forms what can be considered as a charging space. Upon placing the substance, such as tea leaves on the bent flap, the latter serves as a hopper or slide upon a correct inclined positioning of the bag. In this manner the tea leaves are thus positively guided into the bag. Thereafter, the flap serves as a holder for the bag when the latter is introduced into a teapot. The flap may be positioned over the edge of the teapot and may be clamped there, for example by means of the teapot lid. The bag has only little material because the filter material is of double thickness only in the zone of the container part (that is, the bag proper); the flap itself is a sheet of a single thickness. No filter material is wasted in the making of the bag, because no funnel is being formed.

According to a preferred embodiment the seams formed in the two panels diverge in a V-shaped manner in the zone of the opening so that the opening will have inclined edges upon its enlargement. This even further facilitates the introduction of tea leaves into the bag.

DESCRIPTION OF THE PREFERRED EMBODIMENTS

Figure 1:
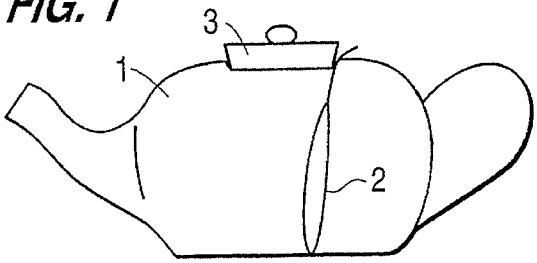
FIG. 1 is a schematic side elevational view of a teapot in which an infusion bag according to the invention is suspended.

Turning to FIG. 1, there is illustrated therein a tea bag 2 which contains tea leaves and which is accommodated in a teapot 1. An end of the tea bag projects from the teapot opening and may be clamped against-an edge thereof by the teapot lid 3 so that the tea bag 2 may be suspended in a vertical orientation.

Figure 2:
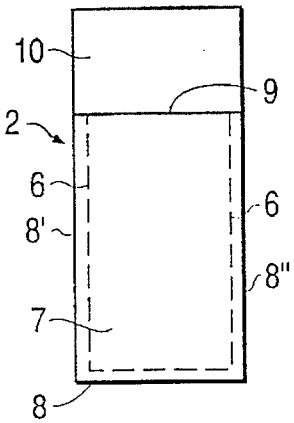
FIG. 2 is a front elevational view of a preferred embodiment of the invention.
Figure 3:
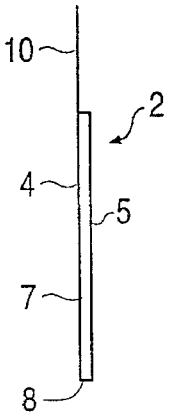
FIG. 3 is a side elevational view of the structure shown in FIG. 2.
Figure 4:
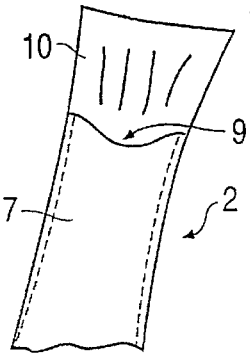
FIG. 4 is a perspective view of the embodiment shown in FIGS. 2 and 3.

Turning to FIGS. 2, 3 and 4 the tea bag illustrated therein is formed of two face-to-face arranged panels 4 and 5 made of filter material which are sealed to one another along a bottom edge 8 and along side edges 8' and 8". The seams 6 obtained by welding the panels 4 and 5 to one another are shown in dotted lines. In the region opposite the bottom edge 8 the bag 2 has an opening 9 through which tea leaves may be inserted into the container part 7 of the bag 2.

According to the invention, the panel 4 is longer than the panel 5 and thus it projects on the side opposite the bottom edge 8 beyond the opening 9 and forms a single-thickness flap 10, by means of which the bag may be suspended in the teapot 1 as shown in FIG. 1. Further, the flap 10 facilitates the charging of the container part 7 with tea leaves because the flap 10 may be utilized as a slide or hopper. For this purpose, the opening 9 is enlarged by slightly compressing the container part 7 in the zone of the opening 9. As a result, the flap 10 is bent in such a manner that it forms a longitudinally extending charging space. If tea leaves are placed on the bent flap 10 when the tea bag is in a properly inclined position, the tea leaves slide down the flap 10 into the enlarged opening and into the container part 7.

Figure 5:
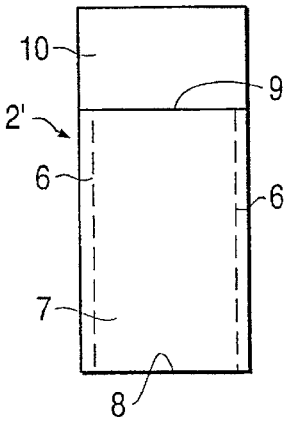
FIG. 5 is a front elevational view of another preferred embodiment of the invention.

Turning to the embodiment shown in FIG. 5, the infusion bag 2' differs from the earlier-described embodiment in that a single panel is used which is folded to form the bottom edge 8. One of the folded panel halves is longer than the other and thus forms the flap 10 which projects beyond the opening 9.

Figure 6:
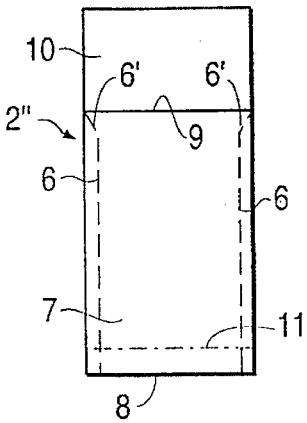
FIG. 6 is a front elevational view of yet another embodiment of the invention.
Figure 7:
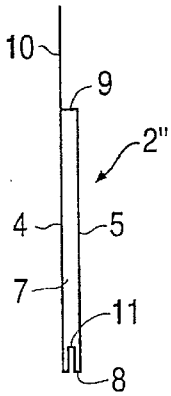
FIG. 7 is a side elevational view of the construction shown in FIG. 6.

Turning to FIGS. 6 and 7, in the infusion bag 2" shown therein, the charging with tea leaves can be further facilitated by arranging the seams 6 in the zone of the opening 9 in an outwardly diverging manner as shown at 6'. Further, in this embodiment, the bottom edge 8 of the bag is formed by a dual (accordion-like) fold 11. For this purpose, the panels 4 and 5 are doubly folded to a small width and thereafter sealed to one another. Such a dual fold results in an increased volume in the region of the bottom edge 8 of the container part 7.

Figure 8:
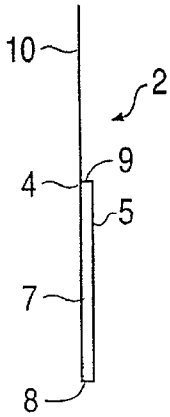
FIG. 8 is a side elevational view of a further embodiment of the invention.

In the embodiment shown in FIG. 8, the opening 9 is situated in the mid region of the bag structure.

It will be understood that the above description of the present invention is susceptible to various modifications, changes and adaptations, and the same are intended to be comprehended within the meaning and range of equivalents of the appended claims.

What is claimed is:

1. An infusion bag of liquid-pervious filter material having a bottom edge and opposite side edges; said bag consisting of face-to-face arranged first and second panels secured to one another along said bottom edge and said side edges; said first and second panels together defining an opening spaced from said bottom edge; said first and second panels having a length dimension viewed in a direction away from said bottom edge; the length dimension of said first panel being greater than the length dimension of said second panel, such that said first panel includes a flap extending beyond said opening in a direction away from said bottom edge; said flap having a length such that when the flap is bent in its longitudinal direction, said opening is enlarged and a charging space is formed above the opening such that upon placing a substance to be infused on the bent flap, the bent flap serves as a hopper or slide for the substance to be filled in the bag, the length of said flap also being of sufficient length such that said flap may be positioned over the edge of a teapot and clamped thereon with a teapot lid, such that said bag may be suspended in the teapot in a vertical position; said flap serving as a sole means for suspending the bag.

2. The infusion bag as defined in claim 1, wherein said first and second panels are two separate components bonded to one another along said bottom edge and said side edges.

3. The infusion bag as defined in claim 1, wherein said first and second panels form a single component folded to form said bottom edge; said first and second panels being bonded to one another along said side edges.

4. The infusion bag as defined in claim 1, wherein said first and second panels are connected to one another at said side edges by sealing seams; said sealing seams being divergent in a V-configuration in a region of said opening in a direction away from said bottom edge.

5. The infusion bag as defined in claim 1, wherein said first and second panels are secured to one another at said bottom edge by an accordion fold.

* * * * *